US005881354A

United States Patent [19]

Shivanath et al.

[11] Patent Number: 5,881,354

[45] **Date of Patent: *Mar. 9, 1999**

[54] SINTERED HI-DENSITY PROCESS WITH FORMING

[75] Inventors: Rohith Shivanath; Peter Jones, both of Toronto, Canada

[73] Assignee: Stackpole Limited, Mississauga, Canada

[ * ] Notice: The term of this patent shall not extend beyond the expiration date of Pat. No. 5,516,483.

[21] Appl. No.: 642,679

[22] Filed: May 3, 1996

[51] Int. Cl.[6] ..... B22F 3/12; B22F 3/24

[52] U.S. Cl. ..... 419/11; 419/25; 419/28; 419/29; 419/38; 419/39

[58] Field of Search ..... 419/53, 23, 11, 419/28, 32, 36, 39, 38, 96, 58, 60, 25, 29

[56] References Cited

U.S. PATENT DOCUMENTS

| | | | |
|---|---|---|---|
| 3,901,961 | 8/1975 | Kondo et al. . | |
| 3,951,697 | 4/1976 | Sherby et al. | 148/12 R |
| 4,014,680 | 3/1977 | Reen . | |
| 4,069,044 | 1/1978 | Mocarski et al. . | |
| 5,009,842 | 4/1991 | Hendrickson et al. . | |
| 5,154,881 | 10/1992 | Rutz et al. . | |
| 5,516,483 | 5/1996 | Shivanath et al. | 419/14 |
| 5,552,109 | 9/1996 | Shivanath et al. | 419/53 |

FOREIGN PATENT DOCUMENTS

| | | |
|---|---|---|
| 57019325 | 10/1980 | Japan . |
| 1512323 | 6/1978 | United Kingdom . |
| 95/21275 | 7/1994 | WIPO . |

OTHER PUBLICATIONS

Super Plastic Forming of Ultrahigh Carbon Alloyed P/M Steels by R. Laag et. al. pp. 409–421

*Primary Examiner*—Daniel J. Jenkins
*Attorney, Agent, or Firm*—Eugene J.A. Gierczak

[57] ABSTRACT

A method of making a sintered article of powder metal having a carbon composition in the range of about 0.8% to 2.0% by weight, then spheroidizing the sintered article and then warm forming the sintered article at a temperature between 250° and 700° C. for a time duration selected to form the article to a final shape.

18 Claims, 9 Drawing Sheets

The eutectoid portion of the Fe-$Fe_3C$ phase diagram

High Density Powder Metal Process Stages - Schematic Diagram

High Density Powder Metal Process Stages - Schematic Diagram

SINTERED HI-DENSITY PROCESS WITH FORMING

This invention relates to a method or process of forming a sintered article of powder metal having an ultra-high carbon content which has been spheroidized and then warm formed to produce improved and consistent dimensional accuracy of the sintered parts. In particular this invention relates to a process of forming a sintered article of powder metal having a high density and ultra-high carbon content between 0.8 and 2% by weight followed by heat treatment to spheroidize the carbides in the micro-structure followed by warm coining to produce an article with combined high strength and dimensional accuracy.

BACKGROUND OF THE INVENTION

Powder metal technology is well known to the persons skilled in the art and generally comprises the formation of metal powders which are compacted and then subjected to an elevated temperature so as to produce a sintered product.

Various processes have heretofore been designed in order to produce sintered articles having high densities. Such processes include a double press double sintering process for densities typically up to 7.5 g/cc as well as hot powder forging where virtually full densities of up to 7.8 g/cc may be obtained. However, such prior art processes are relatively expensive and time consuming. Recently developed methods include warm pressing of powders up to 7.35 g/cc as disclosed in U.S. Pat. No. 5,154,881. However, there are process disadvantages with the warm pressing such as maintaining tool clearances with heated systems. Also warm pressing does not allow very high densities up to above 7.5 g/cc to be easily reached in commonly used alloy systems without double pressing and double sintering.

Moreover, U.S. Pat. No. 5,009,842 refers to a hot forging operation to be carried out on a sintered part after quenching and after pre-heating the part to at least 1,000° C. and then subjecting the pre-heated sintered part to impact. Furthermore, U.S. Pat. No. 3,901,961 illustrates a pre-alloyed steel powder for formation of structural parts by powder forging and powder forged articles for structural parts.

U.S. Pat. No. 4,014,680 teaches pre-alloyed stainless steel powder for liquid phase sintering, while U.S. Pat. No. 4,069,044 illustrates a method of producing forged articles from prealloyed-premixed water atomized ferrous alloy powder.

Moreover, R. Laag et al, in an article entitled "Super Plastic Forming of Ultrahigh Carbon Alloyed PIM Steels", page 409–421 relates to super plastic forming for the production of net-shaped parts produced by inert gas, atomization and Hot Isostatic Pressing, Osprey processing or thermal mechanical treatment of casting alloys.

It is an object of this invention to provide an improved process for producing ultra-high carbon steels having improved dynamic strength characteristics and an accurate method to control the size.

It is a further object of this invention to provide an improved process for producing sintered articles having improved strength characteristics with carbon content between 0.8% to 2.0% carbon which have been spheroidized and an accurate method to control same.

The broadest aspect of this invention relates to a method of making a sintered article of powder metal having a carbon composition in the range of about 0.8% to 2.0% by weight, then spheroidizing said sintered article and then warm forming said sintered article at a temperature between 250° C. and 700° C. for a time duration selected to accurately form said article to a final shape.

DESCRIPTION OF DRAWINGS

These and other features and objects of the invention will now be described in relation to the following drawings:

FIG. 9 is a schematic diagram including warm forming and warm rolling.

DESCRIPTION OF THE INVENTION

Sintered Powder Metal Method

The invention disclosed herein utilizes high temperature sintering of 1250° C. to 1,350° C. and a reducing atmosphere of, for example hydrogen, hydrogen/nitrogen, or in vacuum for the production of ultra high carbon steel powder metal parts. Moreover, the reducing atmosphere in combination with the high sintering temperature reduces or cleans off the surface oxides allowing the particles to form good bonds and the compacted article to develop the appropriate strength.

The lubricant is added in a manner well known to those persons skilled in the art so as to assist in the binding of the powder as well as assist in the ejecting of the product after pressing. An example of lubricant which can be used is Zn stearate. The article is formed by pressing the mixture into shape by utilizing the appropriate pressure of, for example, 25 to 50 tonnes per square inch.

Ultrahigh Carbon Steel

Typically the percentage of carbon steel lies in the range of up to 0.8% by weight carbon. Ultrahigh carbon steels are carbon steels containing between 0.8% to 2% carbon by weight.

Figure 1:
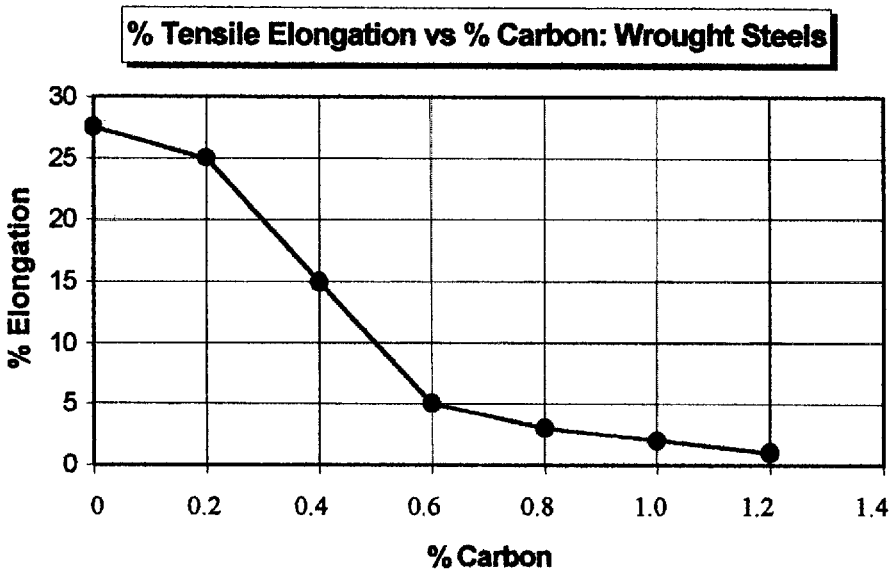
FIG. 1 is an elongation to percent carbon graph.

It is known that tensile ductility decreases dramatically with an increase in carbon content and accordingly ultrahigh carbon steels have historically been considered too brittle to be widely utilized. FIG. 1 shows the relationship between elongation or ductility versus the carbon content of steels. It is apparent from FIG. 1 that the higher the percentage of carbon, the less ductile the steel. Moreover, by reducing the carbon in steels, this also reduces its tensile strength.

However, by using the appropriate heat treatments for ultrahigh carbon steels, high ductilities as well as high strengths may be obtained.

Hi-Density Ultrahigh Carbon Steel Powder Metals

Hi-Density Ultrahigh Carbon Steels have been produced by the applicant utilizing one of two methods. The first method comprises a Hi-Density Sintered Alloy Process with Spheroidization Method disclosed in U.S. application Ser. No. 08/193,578 filed 02/08/94 while the second comprises a Hi-Density Sintered Alloy and Spheroidization Method for Pre-Alloy Powders disclosed in U.S. patent application Ser. No. 08/496,726 filed 06/29/95.

Hi-Density Sintered Alloy and Spheroidization Method for Pre-Alloyed Powders

Figure 2:
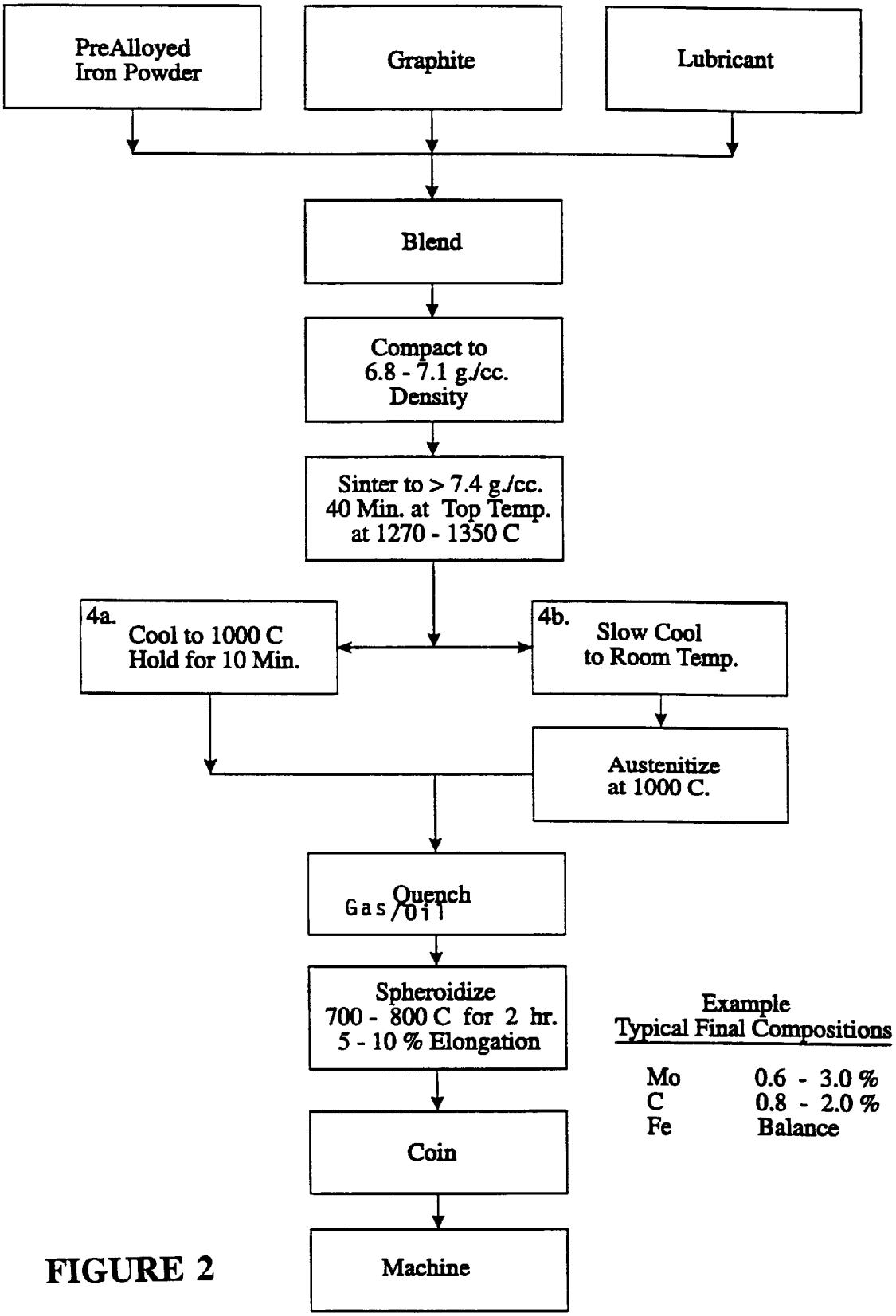
FIG. 2 is a flow chart.

Such method includes blending graphite and lubricant with a pre-alloyed iron based powder as described herein and illustrated in FIG. 2. An example of the graphite utilized herein consists of 3203 grade from Asbury but can include other grades of graphite.

The pre-alloyed powder used herein consists of a metallic powder composed of two or more elements which are alloyed in the powder manufacturing process, and in which the particles are of the same nominal composition throughout.

The method described herein may be adapted to produce a high density grade powder metal sintered product having an ultrahigh carbon content with the following composition by weight:

| | |
|---|---|
| Mo | 0.5–3.0% |
| C in the form of graphite | 0.8 to 2.0% |
| Fe and other unavoidable impurities | the remainder |

The graphite is blended with the lubricant and the pre-alloyed iron based powder containing molybdenum is then compacted by conventional pressing methods to a minimum of 6.8 g/cc. Sintering then occurs in a vacuum, or in a vacuum under partial backfill (i.e. bleed in argon or nitrogen), or pure hydrogen, or a mixture of $H_2/N_2$ at a temperature of 1250° C. to 1350° C. and in particular 1270° C. to 1310° C. The vacuum typically occurs at approximately 200 microns. Moreover, the single step compaction typically occurs preferably between 6.8 g/cc to 7.1 g/cc.

By utilizing the composition referred to above, hi-density as sintered articles greater than 7.4 g/cc can be produced in a single compression single sinter stage rather than by a double pressing, double sintering process. Hi-density sintered articles can be produced having a sintered density of 7.4 g/cc to 7.8 g/cc.

Figure 3:
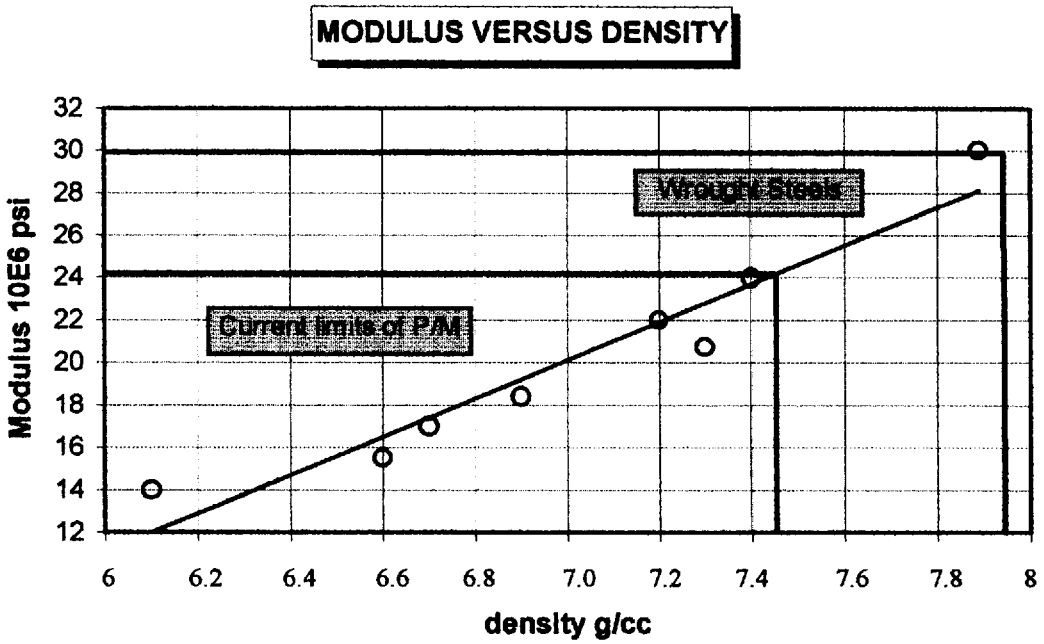
FIG. 3 is a modulus to density graph.

FIG. 3 shows the relationship between the density of a sintered article and the modulus. It is apparent from FIG. 3 that the higher the density the higher the modulus.

It should be noted that tensile strengths of approximately 100–120 ksi as well as impact strengths of approximately 50 foot pounds have been achieved by using the high density sintered alloy method described herein.

By adding the graphite to the pre-alloyed powder and sintering same in a vacuum or vacuum with backfill, or pure hydrogen or $N_2H_2$, at a temperature of 1270° C. to 1350° C., a high density sintered alloy can be produced via supersolidus sintering. With respect to the composition referred to above, an alloy having a sintered density of 7.6 g/cc may be produced by single stage compaction and sintering at 1280° C. to 1310° C. under vacuum, or in a reducing atmosphere containing $H_2/N_2$.

Particularly good results have been achieved by utilizing a pre-alloyed iron based powder of iron with 0.85% molybdenum in the pre-alloyed form blended with a 1.5% graphite addition and a lubricant. More particularly a suitable commercial grade which is available in the market place is sold under the designation of QMP AT 4401 which has the following quoted physical and chemical properties:

| | |
|---|---|
| Apparent density | 2.92 g/cm$^3$ |
| Flow | 26 seconds/50 g. |
| Chemical Analysis By Weight: | |
| C | 0.003% |
| O | 0.08% |
| S | 0.007% |
| P | 0.01% |
| Mn | 0.15% |
| Mo | 0.85% |
| Ni | 0.07% |
| Si | 0.003% |
| Cr | 0.05% |
| Cu | 0.02% |
| Fe | greater than 98% |

The commercially available pre-alloy referred to above consists of 0.85% by weight molybdenum pre-alloyed with iron and unavoidable impurities. The existence of unavoidable impurities is well known to those persons skilled in the art.

Other grades of pre-alloyed powder may be employed. Graphitising elements such as Ni and Si (other than as trace elements) are to be avoided.

Ultrahigh Carbon Steel Powder Metals with Hi-Density Sintered Alloys

Ultra high carbon steel powder metals have also been produced by applicant by adding iron powder with ferro alloys as disclosed in U.S. application Ser. No. 08/193,578. Such method can be utilized to produce a high density grade powder metal having an ultrahigh carbon content with the following sintered composition by weight:

| | |
|---|---|
| Mn | 0.5–2.5% |
| Mo | 0–2.0% |
| Cr | 0–2.0% |
| P | 0–0.5% |
| C | 0.8 to 2.0% |
| Fe and other unavoidable impurities | remainder |

By adding the ferro alloys referred to above, namely ferro magnesium, ferro molybdenum, ferro chromium, and ferro phosphorous with 0.8% to 2.0% carbon to the base powder iron and sintering same in a vacuum or vacuum with backfill, or pure hydrogen at a temperature of 1280° C. to 1380° C., a high density sintered alloy can be produced via supersolidus sintering. With respect to the composition referred to above, an alloy having a sintered density of up to 7.8 g/cc (i.e. near full density) may be produced by single stage compaction and sintering at 1315° C. under vacuum, or in a reducing atmosphere containing $H_2/N_2$.

The base iron powder composition consists of commercially available substantially pure iron powder which preferably contains less than 1% by weight of unavoidable impurities. Examples of such iron powders include Hoeganaes Ancorsteel 1000/1000B/1000C, QMP29 and QMP 1001.

It should be noted that iron has a ferrite and austenite phase. Moreover, up to 0.8% carbon can be dissolved in ferrite or (alpha) phase, and up to 2.1% in the austenite or (gamma) phase. The transition temperature between the ferrite and austenite phase is approximately 727° C.

Heat Treatment—Spheroidization

Figure 4:
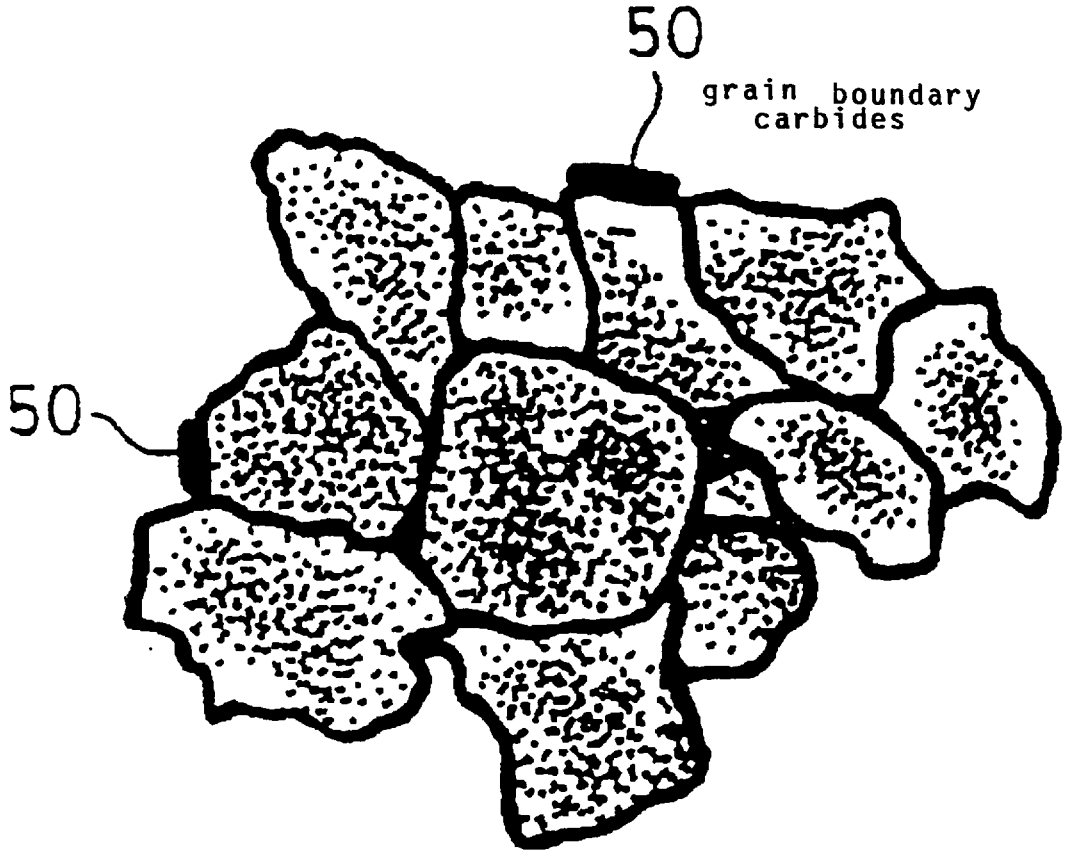
FIG. 4 is a sketch of grain boundary carbides in an as sintered article.
Figure 5:
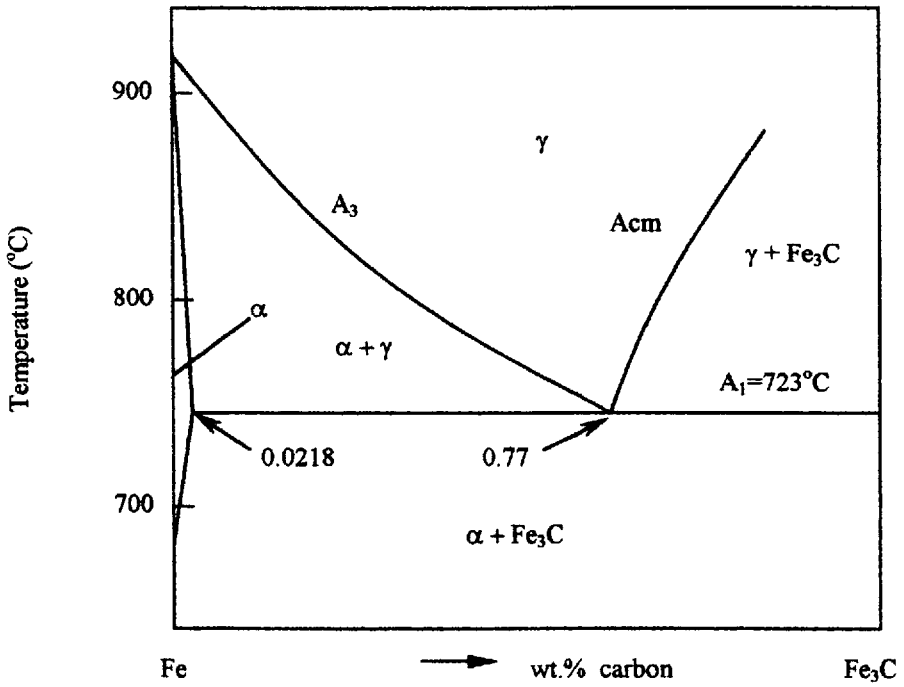
FIG. 5 illustrates the eutectoid portion of the Fe—$Fe_3C$ phase diagram.

The sintered ultrahigh carbon steel powder metal parts produced in accordance with the methods described above exhibit a hi-density although the article will tend to be brittle for the reasons described above. In particular, the brittleness occurs due to the grain boundary carbides 50, which are formed as shown in FIG. 4. The grain boundary carbides 50 will precipitate during the austenite to ferrite transformation during cooling, due to the difference in carbon solubilities in austentite and ferrite described above.

Spheroidization is the process of heat treatment that changes embrittling grain boundary carbides and other angular carbides into a rounded or globular form.

Figure 6A:
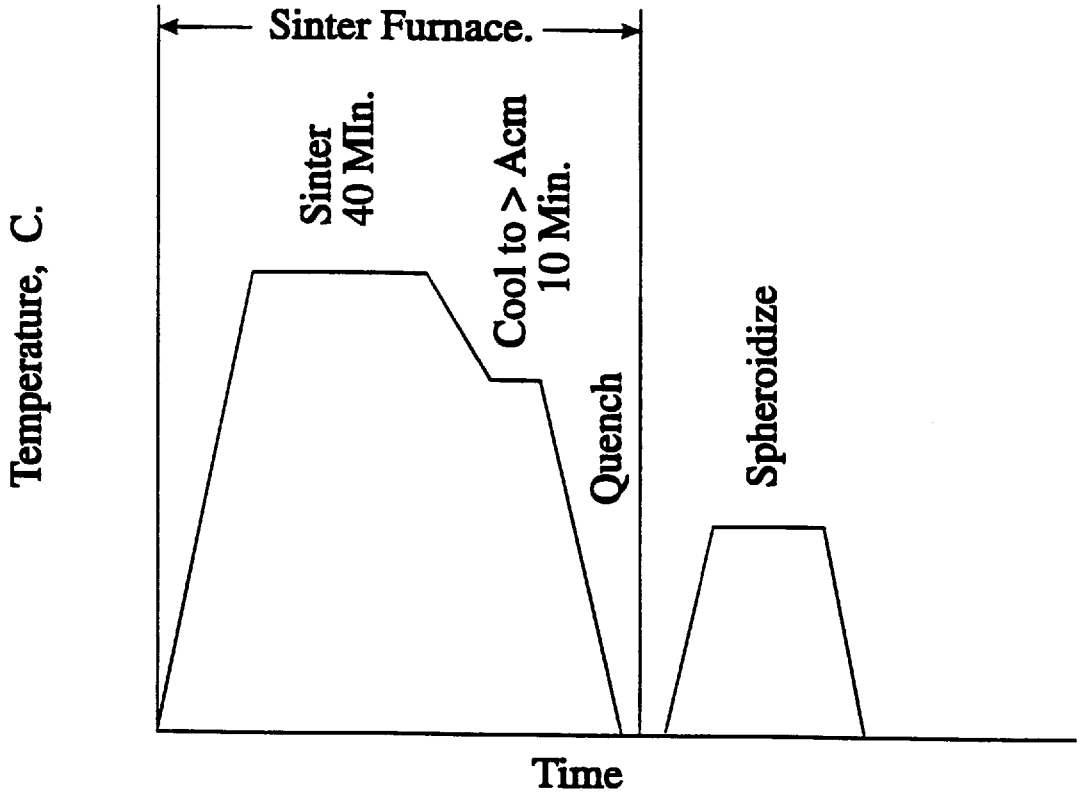
FIG. 6*a* is a schematic diagram of the high density powder metal process stages.

A method for spheroidization has been developed for high density sintered components whereby the parts are sintered, cooled within the sinter furnace to above the $A^{CM}$ of approximately 1000° C. and rapidly quenched to below 200° C., by quenching in oil or by high pressure gas so that the precipitation of embrittling grain boundary carbides is prevented or minimised. This process results in the formation of a metastable microstructure consisting largely of retained austenite and martensite. A subsequent heat treatment whereby the part is raised to a temperature near the $A_1$ temperature (700° C. to 800° C.) results in relatively rapid spheroidization of carbides, and combined high strength and ductility. FIG. 6*a* is a graph which illustrates this method for spheroidization. The process of FIG. 6*a* is also illustrated in FIG. 2. The quenching which is illustrated graphically in FIG. 6*a* may occur by oil quenching or by high pressure gas. The latter is made possible by formulating alloys to have high hardenabilities, for example by the addition of higher levels of chromium and molybdenum.

Figure 6B:
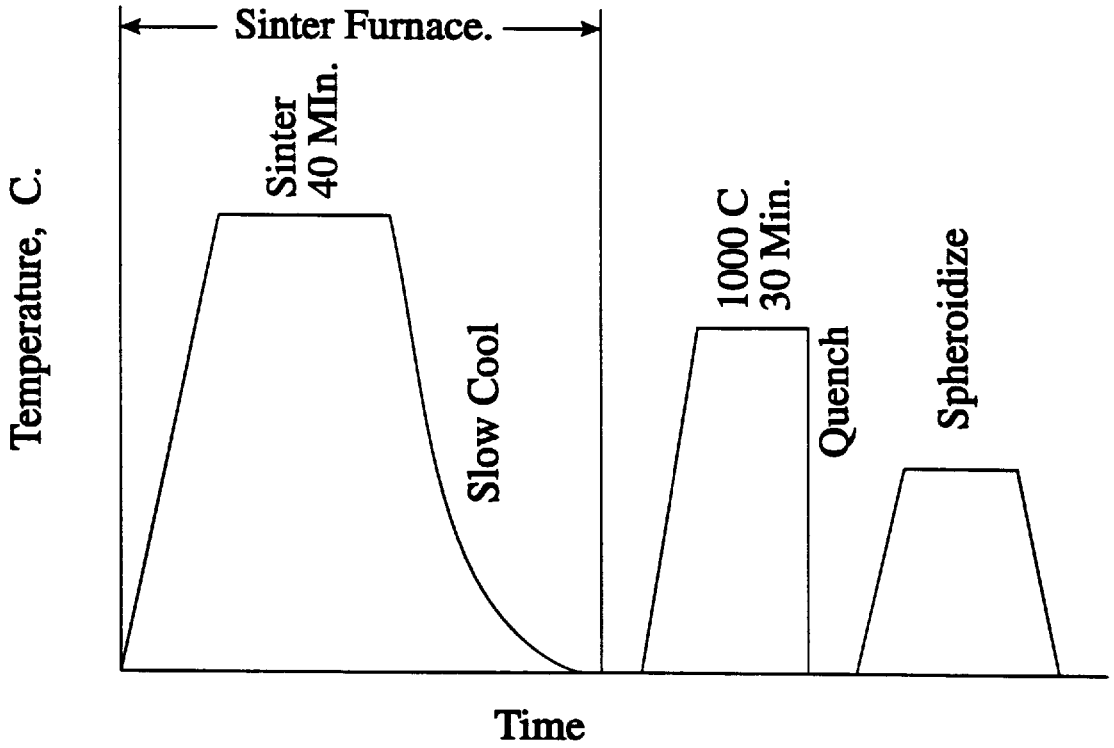
FIG. 6*b* is a schematic diagram of another embodiment of the high density powder metal process stages.

In another embodiment, parts are sintered as described above, in the first stage, but allowed to cool to room temperature as shown in FIG. 6*b*. The sintered microstructure will therefore contain the embrittling carbides. The second stage is carried out on a separate heat treatment line, whereby parts are austenitised at approximately 1000° C. to dissolve the carbides, and oil quenched, followed by spheroidization.

Accordingly, by spheroidizing the as sintered ultrahigh carbon steel, such process gives rise to a powder metal having high ductility, typically 5–10% tensile elongation and high strength of 100–120 ksi UTS. The spheroidizing treatment causes the carbides to assume a rounded, less brittle form.

The powder metal ultrahigh carbon steel that has been spheroidized, gives rise to a hi-density P/M steel having a good balance of properties with high strength and ductility.

Warm Forming

By utilizing the ultra-high carbon steel spheroidizing methods referred to above, densities of 7.6 to 7.8 g/cc are achieved. The dimensional accuracy of the sintered part is improved by including a warm forming process after spheroidizing.

Forming process may comprise:

1. Sizing, which consists of applying pressure to true up the dimensional size.

2. Coining, which is also utilized to true up the dimensional size, but may also introduce a feature imparted to the sintered article, such as a chamfer or groove. In accordance with the invention described herein, warm forming is accomplished in the broadest temperature range between 250° and 700° C., and preferably in the range of 600° to 700° C.

The hi-density ultra-high carbon steel sintered part which has been spheriodized as disclosed above is subjected to a temperature preferably in the range of 500° to 700° C., then the coining or sizing operation is undertaken. During the warm forming stage the sintered part is introduced into a mold or cavity die and subjected to a pressure or tonnage in the range of 40 tonnes.

By warm forming difficulties arising from spring back may be alleviated. Spring back may be defined as the elastic expansion upon release of the compacting or coining forces. Spring back of a sintered powder metal part is related to the tonnage of a particular press. Generally speaking, the higher the tonnage, the higher the spring back, and the greater the difficulty in obtaining a dimensionally consistent precision shaped, sintered powder metal part.

Figure 7:
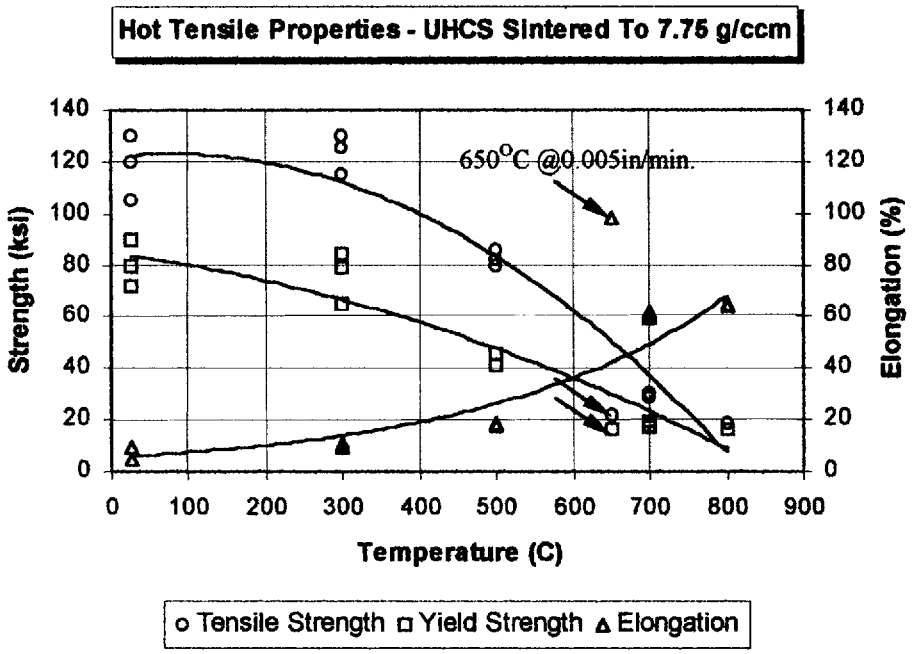
FIG. 7 illustrates hot yield strength properties of ultra-high carbon steels sintered to 7.75 g/cc.
Figure 8:
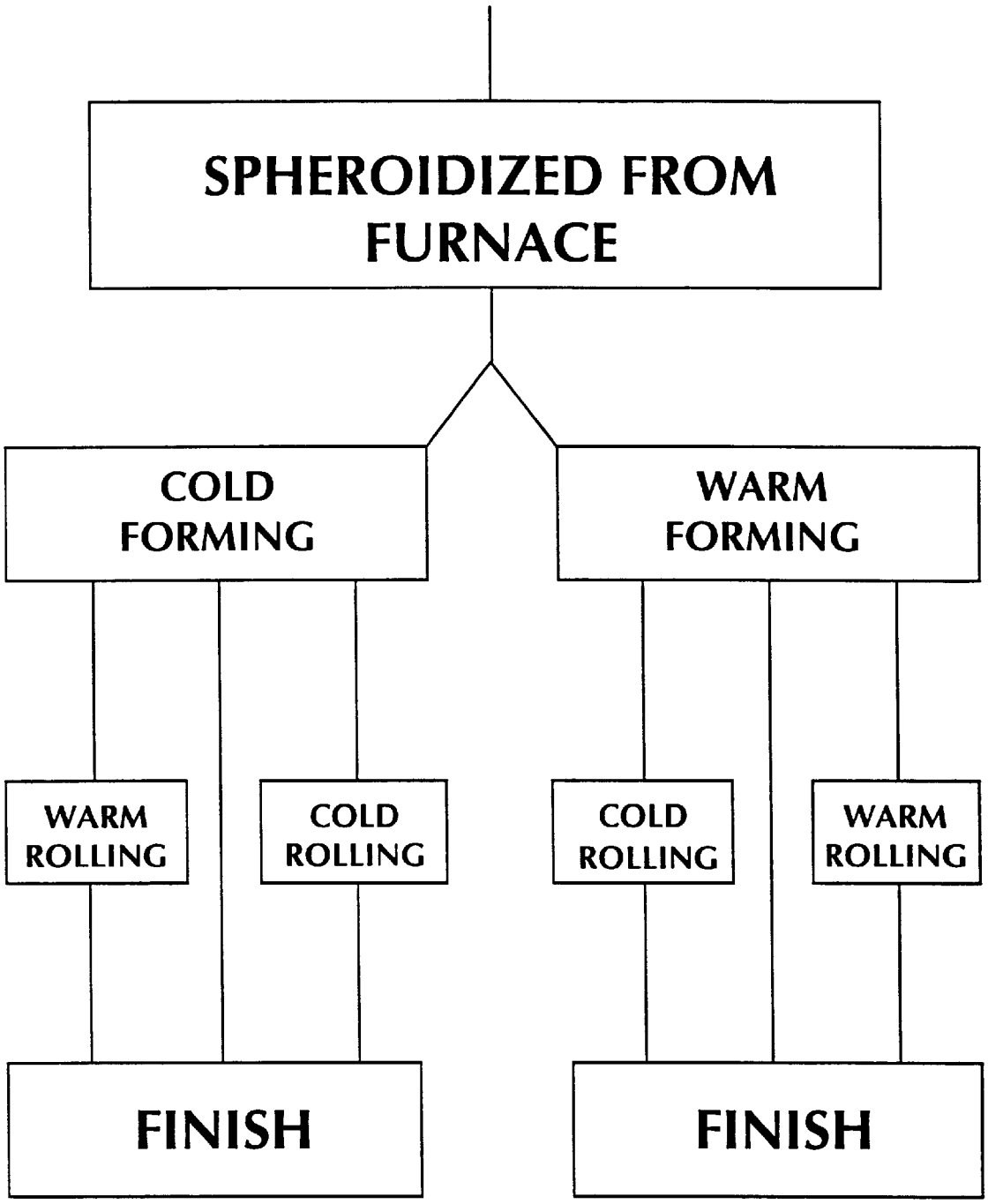
FIG. 8 illustrates hot elongation of ultra-high carbon steels sintered to 7.75 g/cc.

FIGS. 7 and 8 are charts which illustrate the tensile properties of ultra-high carbon steels sintered to 7.75 g/cc. FIG. 7 illustrates that the yield strength of the ultra-high carbon steel drops with an increase in temperature while FIG. 7 shows that there is a corresponding increase in the percent elongation with increase in temperature. Generally speaking these charts illustrate that the yield strength can be reduced with a corresponding increase in ductibility if optimized in the temperature range between 500° and 700° C. Accordingly, by utilizing the warm forming step described herein, one can reduce the tonnage required to move the metal since the percent elongation is increased and the yield stress are reduced in this temperature range. Accordingly, the spring back is reduced and much tighter dimensional control may be achieved.

Moreover, the application of the warm forming pressure may be applied over a longer period of time (i.e. at lower strain rates) than, for example, in the case of cold coining. Cold coining of ultra-high carbon sintered parts which have been spheroidized may occur at the rate of fifteen strokes per minute. Warm forming, on the other hand, may be applied at a much slower rate of, for example, one to two stokes per minute. Production however may be increased by utilizing multi-cavity dies.

The warm forming step is utilized to move more of the metal than during a cold coining process. Accordingly, the warm coining process is utilized to improve the accuracy of the sintered parts as well as reduce the tonnages on a particular press.

Moreover other advantages can be achieved by utilizing the warm forming step described herein. For example, conventional powder forging occurs at temperature ranges in the vicinity of 1000° C. Such conventional powder forging has been undertaken in the past with starting sintered densities of 7.0 g/cc at a temperature of 1000° C. so as to produce articles having near full densities of 7.86 g/cc. However, such sintered powder forged articles tend to suffer from surface oxidization because of the relatively high temperature range and low starting density. Such surface oxidization has a determinental effect on the fatigue endurance of the sintered part. Warm forming at 500° to 700° C. reduces the surface oxidization compared to powder forging.

Moreover, by utilizing a lower temperature range of 500° to 700° C. the manufacturing process is less costly than that required for conventional powder forging undertaken at temperatures of approximately 1000° C.

The warm forming process requires lower tonnages than that required for cold coining. Furthermore multiple cavities may be utilized in order to warm form sintered parts which would otherwise not be possible by utilizing cold coining. Moreover, as stated earlier other features such as grooves or keyways or camfers may be introduced by using warm forming.

Accordingly by using the invention as described herein one starts with a higher density and produces a sintered part having cleaner microstructure by utilizing warm forming between 500° and 700° C. since such part does not suffer as much oxidization as in conventional powder forming. Furthermore, precision in the production of consistent parts are more difficult to achieve by conventional powder forging than that achieved by warm forming.

Roll Forming

A roll forming step may be utilized to increase the dimensional precision of the sintered part after warm forming. Such roll forming step may be accomplished through utilizing a single die or twin die rolling machine and may include simultaneous root and flank rolling or selective rolling of flank or root sections.

The rolling die typically comprises a mating gear made from hardened tool steel which is engaged with the sintered gear blank and as the two are rotated their axes are brought together to compact and roll the selected areas of the blank surfaces. Such roll forming can by utilized to selectively densify the outer gear regions.

High strength powder metal transmission gears can be produced by the method described herein, namely by producing the ultra high carbon steel followed by spheroidizing, followed by warm forming, followed by warm roll forming. Moreover warm rolling may be utilized so as to reduce ring pressures. By warm rolling at temperatures between 500° and 700° C. the advantages over spring back and suface oxidization referred to are observed.

Heat Treatment

Subsequent heat treatment steps may be applied such as:

1. Induction harding of the teeth of the gear. Such induction hardening step may include:

(a) austenitizing (b) quenching in oil and (c) temper

2. Thorough hardening by:

(a) austenitizing (b) quenching in oil or by high pressure gas, and (c) tempering Although the preferred embodiment as well as the operation and use have been specifically described in relation to the drawings, it should be understood that variations in the preferred embodiment could be achieved by a person skilled in the trade without departing from the spirit of the invention as claimed herein.

We claim:

1. A method of making a sintered article of an iron based powder metal having a carbon composition in the range of about 0.8% to 2.0% by weight, then spheroidizing said sintered article and then warm forming said sintered article at a temperature between 250° C. and 700° C. for a time duration selected to form said article to a final shape.

2. A method as claimed in claim 1 wherein said time duration is between 30 and 60 seconds.

3. A method as claimed in claim 2 wherein said warm forming temperature is between 500° and 700° C.

4. A method as claimed in claim 3 wherein said warm forming comprises warm coining.

5. A method as claimed in claim 4 wherein said warm coining is followed by roll forming at ambient temperatures.

6. A method as claimed in claim 5 wherein said roll forming comprises warm rolling at a temperature between 500° and 700° C.

7. A method as claimed in claim 5 wherein said sintered article is produced by:

(a) blending (i) carbon (ii) separate ferro alloy particles of ferro manganese, ferro molybdenum, ferro chromium, and ferro phosphorous;

(iii) lubricant with (iv) compressible iron powder (b) pressing said blended mixture to shape in a single compaction stage;

(c) then high temperature sintering said article at a temperature of at least 1,280° C. in a reducing atmosphere.

8. A method as claimed in claim 5 wherein sintered article is produced by:

(a) blending graphite (b) with a pre-alloyed iron powder containing about 0.5% to 3.0% molybdenum; and (c) pressing said blended mixture in a single compaction stage;

(d) sintering said article at a temperature between 1,250° and 1,350° C.

9. A method as claimed in claim 7 wherein said sintered article of powder metal contains by weight from 0.5% to 2.5% manganese from 0% to 2.0% molybdenum from 0% to 2.0% chromium from 0% to 0.5% phosphorous from 0.8% to 2.0% carbon the balance essentially iron and unavoidable impurities.

10. A method as claimed in claim 8 wherein said molybdenum comprises approximately 0.85% by weight of said sintered article.

11. A method of warm forming a spheroidized sintered article of powder metal having a carbon composition in the range about 0.8% to 2.0% by weight and density in the range of about 7.6 to 7.8 g/cc, by warm forming said article at a temperature between 250° C. to 700° C., for a time duration between 30 and 60 seconds so as to produce an article to a final shape.

12. A method as claimed in claim 11 wherein said spheroidized sintered article of powder metal is introduced into a die cavity during warm forming and subjected to a pressure.

13. A method as claimed in claim 12 wherein said pressure is at about 40 tonnes.

14. A method as claimed in claim 13 wherein a groove is introduced into said article during said warm forming.

15. A method as claimed in claim 14 wherein a keyway is introduced into said article during said warm forming.

16. A method as claimed in claim 15 wherein a chamfer is introduced into said article during said warm forming.

17. A method of warm forming a sintered and then spheroidized article of powder metal having a carbon composition in the range of about 0.8% to 2.0% by weight and density in the range of about 7.6 to 7.8 g/cc, by warm forming said article at a temperature and time duration selected to reduce the yield strength and increase percentage elongation of the sintered and spheroidized article during warm forming so as to produce an article to final shape.

18. A method as claimed in claim 7 or 8 wherein said article is spheroidized by:

(a) cooling said sintered article within a sintering furnace to above the transitional temperature between the austenite and austenite plus iron carbide phase;

(b) rapidly quenching said sintered article to below 200° C.;

(c) raising the temperature to about 700° C. to 800° C. so as to rapidly spheroidize said carbides.

* * * * *